US010603530B2

(12) United States Patent
Thomas, III

(10) Patent No.: US 10,603,530 B2
(45) Date of Patent: Mar. 31, 2020

(54) TIME DELAYED ACTUATION MECHANISM FOR A FIRE EXTINGUISHER

(71) Applicant: Robert S. Thomas, III, Baltimore, MD (US)

(72) Inventor: Robert S. Thomas, III, Baltimore, MD (US)

( * ) Notice: Subject to any disclaimer, the term of this patent is extended or adjusted under 35 U.S.C. 154(b) by 9 days.

(21) Appl. No.: 16/035,404

(22) Filed: Jul. 13, 2018

(65) Prior Publication Data

US 2019/0015691 A1 Jan. 17, 2019

Related U.S. Application Data

(60) Provisional application No. 62/533,083, filed on Jul. 16, 2017.

(51) Int. Cl.
*A62C 13/64* (2006.01)

(52) U.S. Cl.
CPC ..... *A62C 13/64* (2013.01)

(58) Field of Classification Search
CPC ..... A62C 13/62; A62C 13/64; A62C 13/76
See application file for complete search history.

(56) References Cited

U.S. PATENT DOCUMENTS

| | | | | |
|---|---|---|---|---|
| 1,326,927 | A | 1/1920 | Hall | |
| 3,228,474 | A | 1/1966 | Huthsing, Jr. | |
| 6,702,033 | B1 | 3/2004 | Mitchell et al. | |
| 7,389,825 | B2 * | 6/2008 | Gross | A62C 3/00 102/367 |
| 8,024,849 | B2 | 9/2011 | Geyer | |
| 8,083,003 | B2 | 12/2011 | Felten et al. | |
| 8,869,905 | B2 | 10/2014 | Thomas, III et al. | |
| 2013/0240221 | A1 * | 9/2013 | Chaney | A62C 13/64 169/46 |
| 2017/0368389 | A1 * | 12/2017 | Baxendell | A62C 3/07 |

* cited by examiner

*Primary Examiner* — Darren W Gorman
(74) *Attorney, Agent, or Firm* — Welsh Flaxman & Gitler LLC

(57) ABSTRACT

A fire extinguisher with an actuation mechanism includes a fire extinguisher canister filled under pressure with a fire suppressant in a manner forcibly causing the fire suppressant to be expelled from the fire extinguisher with substantial force upon release. An actuation mechanism is secured to the fire extinguisher canister for controlling expulsion of the fire suppressant from the fire extinguisher canister. The actuation mechanism includes a pneumatically controlled time delayed activation piston assembly that functions to control the release of the fire suppressant until desired by the user of the fire extinguisher. The pneumatically controlled time delayed activation piston assembly includes an actuator housing having a passageway in which a piston is positioned. The actuator housing includes a first end and second end, the first end of the actuator housing being covered with a first cap supporting a spring interposed between the piston and the first cap, and the second end of the actuator housing being provided with a second cap. The piston includes a first end with an annular shaped recess and a second end with a sealed piston head. The piston, under the control of balanced spring bias and pneumatic pressure, allows for time delayed release of the fire suppressant from the fire extinguisher canister.

20 Claims, 11 Drawing Sheets

Fig. 7B
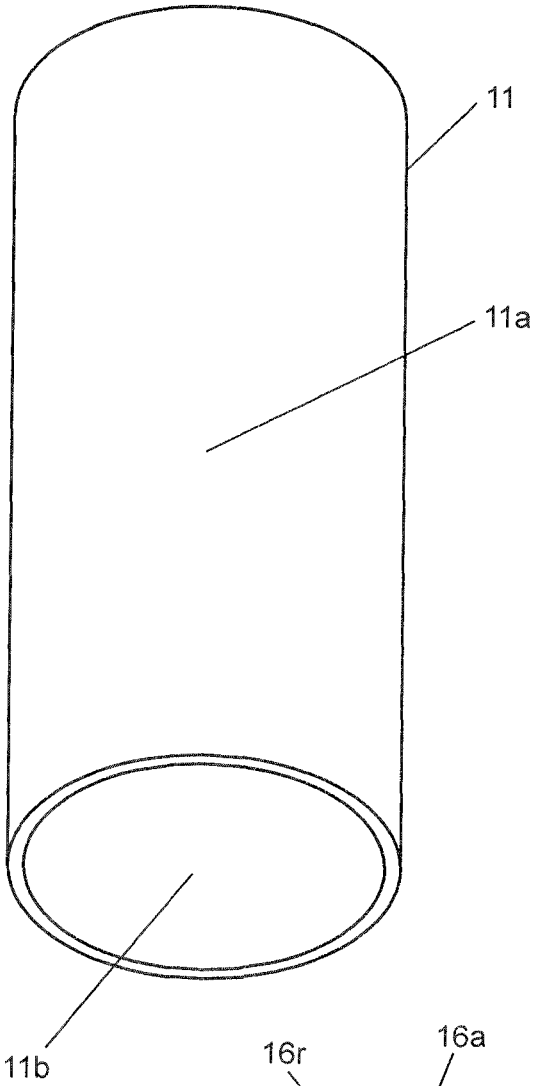
Fig. 7C
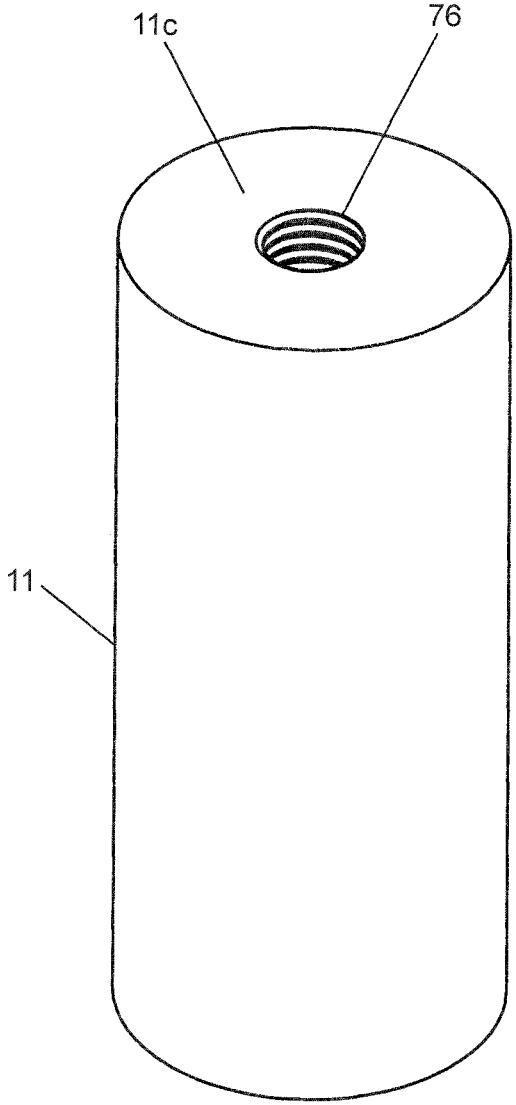
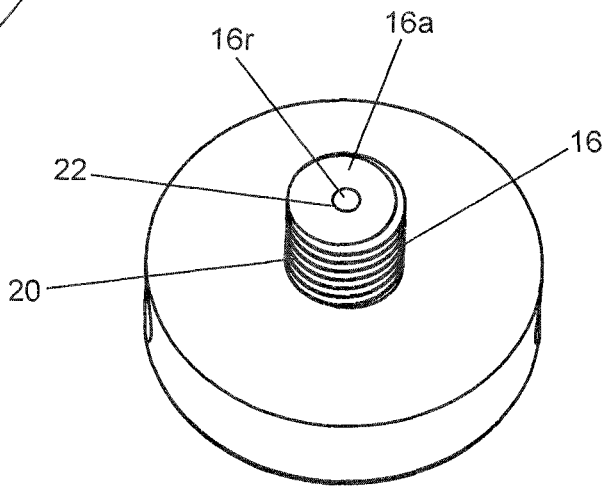
Fig. 7D

TIME DELAYED ACTUATION MECHANISM FOR A FIRE EXTINGUISHER

CROSS REFERENCE TO RELATED APPLICATION

This application claims the benefit of U.S. Provisional Patent Application Ser. No. 62/533,083, entitled "TIME DELAYED ACTUATION MECHANISM FOR A FIRE EXTINGUISHER," filed Jul. 16, 2017.

BACKGROUND OF THE INVENTION

1. Field of the Invention

The invention relates to fire extinguishers. More particularly, the invention relates to a time delayed actuation mechanism for a fire extinguisher.

2. Description of the Related Art

Typical fire extinguishers include a simple pin and trigger mechanism for actuation thereof. The pin is pulled allowing for movement of the trigger, which opens a valve and allows for the flow of the fire suppressant from the fire extinguisher body.

However, it is at times desirable to control the actuation mechanism for timed release of the fire suppressant from the fire extinguisher. Such actuation mechanisms are, however, either highly limited in their functionality to control the release of fire suppressant from the fire extinguisher or they are highly complicated, and ultimately very expensive. In addition, such mechanisms are currently designed for specific fire extinguisher constructions and, therefore, are not available for use in conjunction with a wide range of fire extinguishers.

A need, therefore, exists for an actuation mechanism capable of controlling the release of fire suppressant from a fire extinguisher which is versatile, inexpensive and universal.

SUMMARY OF THE INVENTION

It is, therefore, an object of the present invention to provide a fire extinguisher with an actuation mechanism. The assembled device includes a fire extinguisher canister filled under pressure with a fire suppressant in a manner forcibly causing the fire suppressant to be expelled from the fire extinguisher with substantial force upon release. The assembled device also includes an actuation mechanism secured to the fire extinguisher canister for controlling expulsion of the fire suppressant from the fire extinguisher canister. The actuation mechanism includes a pneumatically controlled time delayed activation piston assembly that functions to control the release of the fire suppressant until desired by the user of the fire extinguisher. The activation piston assembly includes an actuator housing having a passageway in which a piston is positioned. The actuator housing includes a first end and second end. The first end of the actuator housing is covered with a first cap supporting a spring interposed between the piston and the first cap, and the second end of the actuator housing is provided with a second cap. The piston includes a first end with an annular shaped recess and a second end with a sealed piston head. The piston, under the control of balanced spring bias and pneumatic pressure, allows for time delayed release of the fire suppressant from the fire extinguisher canister.

It is also an object of the present invention to provide a fire extinguisher wherein the first end of the piston is shaped and dimensioned for engaging an end of the spring opposite the first cap at the first end of the actuator housing, which spring biases the piston toward the second end of the actuator housing.

It is another object of the present invention to provide a fire extinguisher wherein the sealed piston head is shaped and dimensioned for engaging an inner wall of the passageway of the actuator housing in a manner defining a substantially sealed lateral compartment in the actuator housing between the second end of the piston and the second cap.

It is a further object of the present invention to provide a fire extinguisher wherein the sealed piston head is provided with a circumferential recess in which an O-ring is positioned.

It is also an object of the present invention to provide a fire extinguisher wherein a central section of the piston is also provided with a circumferential recess in which an O-ring is positioned, the O-ring of the sealed piston head at the second end of the piston and the O-ring of the central section form a sealed section.

It is another object of the present invention to provide a fire extinguisher wherein the second cap includes a vent hole allowing air from the sealed lateral compartment to be forced out of the sealed lateral compartment.

It is a further object of the present invention to provide a fire extinguisher wherein the annular shaped recess allows for positioning of a locking pin therein for preventing movement of the piston and provides a pathway for the flow of fire suppressant.

It is also an object of the present invention to provide a fire extinguisher further including a locking pin holding the piston in a desired orientation prior to use.

It is another object of the present invention to provide a fire extinguisher wherein the pneumatically controlled time delayed activation piston assembly is secured to the fire extinguisher via an attachment sleeve that connects the actuation mechanism to the fire extinguisher in a manner permitting fluid communication from the fire extinguisher.

It is a further object of the present invention to provide a fire extinguisher wherein the sealed piston head is shaped and dimensioned for engaging an inner wall of the passageway of the actuator housing in a manner defining a substantially sealed lateral compartment in the actuator housing between the second end of the piston and the second cap, the sealed piston head being provided with a circumferential recess in which an O-ring is positioned and a central section of the piston is also provided with a circumferential recess in which an O-ring is positioned, the O-ring of the sealed piston head at the second end of the piston and the O-ring of the central section forming a sealed section preventing the flow of fire suppressant from the fire extinguisher when the sealed section is aligned with the attachment sleeve.

It is also an object of the present invention to provide an actuation mechanism for controlling expulsion of the fire suppressant from the fire extinguisher canister.

Other objects and advantages of the present invention will become apparent from the following detailed description when viewed in conjunction with the accompanying drawings, which set forth certain embodiments of the invention.

BRIEF DESCRIPTION OF THE DRAWINGS

FIGS. 7A, 7B, 7C and 7D are perspective views of the fire extinguisher, the fire extinguisher housing on its side, the fire extinguisher housing standing up, and the pneumatically controlled time delayed activation piston assembly, respectively.

DESCRIPTION OF THE PREFERRED EMBODIMENTS

Figure 1:
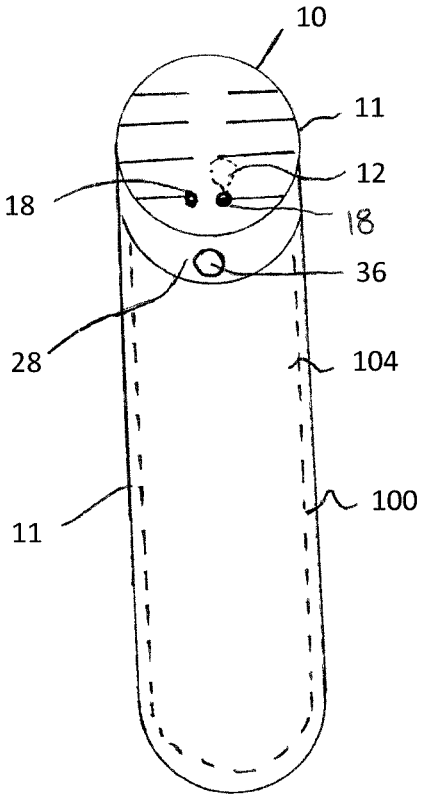
FIG. 1 is a perspective view of the actuation mechanism.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With reference to the various figures, an actuation mechanism 10 for a fire extinguisher 100 is disclosed. The actuation mechanism 10 is designed for permitting controlled, time delayed release of fire suppressant 102 expelled from the fire extinguisher 100. The present actuation mechanism 10, when secured to a fire extinguisher 100 is designed to be thrown at or near a fire. The fire extinguisher and actuation mechanism are referred to herein as the assembled device 1. The fire extinguisher 100 with the present actuation mechanism 10 is a non-pyrotechnic operated system. Non-pyrotechnic operation eliminates the risk of "secondary" fire due to a pyrotechnic ignition device. The present actuation mechanism 10 can be used on existing fire extinguisher bodies, or with a special designed container. The actuation mechanism 10 will operate with any existing suppressant agent; for example, dry chemical, water or other suppressant agents. In addition, it is appreciated that although the present invention is disclosed as being used in conjunction with fire suppressant in accordance with a preferred embodiment, it may be used for the time delayed release of various materials.

Briefly, the present invention is composed of a fire extinguisher 100 filled under pressure with a fire suppressant in a manner forcibly causing the fire suppressant 102 to be expelled from the fire extinguisher 100 with substantial force upon release. The fire extinguisher 100 is secured to an actuation mechanism 10 for controlling expulsion of the fire suppressant 102 from the fire extinguisher 100 in time delayed manner. The actuation mechanism 10 includes a pneumatically controlled time delayed activation piston assembly 14 that functions to control the release of the fire suppressant 102 until desired by the user of the fire extinguisher 100. The pneumatically controlled time delayed activation piston assembly 14 includes an actuator housing 24 having a passageway 25 in which a piston 26 is positioned. In accordance with a preferred embodiment, both the passageway 25 and the piston 26 have a circular cross-sectional profile. The actuator housing 24 includes a first end 28 and a second end 30 with the passageway 25 extending therebetween. The first end 28 of the actuator housing 24 is covered with a first cap 36 supporting a spring 38 interposed between the piston 26 and the first cap 36 in the passageway 25, and the passageway 25 at the second end 30 of the actuator housing 24 is provided with a second cap 42. The piston 26 includes a first end 48 with an annular shaped recess 54 and a second end 50 with a sealed piston head 58. The piston 26, under the control of balanced spring bias from the spring 38 and pneumatic pressure established between the sealed piston head 58 and the second cap 42, allows for time delayed release of the fire suppressant 102 from the fire extinguisher 100.

As will be appreciated based upon the following disclosure, the present actuation mechanism 10 is a pull actuated device designed to be tossed into enclosed spaces with active fires to provide controlled, time delayed fire suppression. When used by first responders, it provides controlled, time delayed suppression of the fire until dedicated fire personnel and equipment arrive. In addition, the fire extinguisher 100 with the present actuation mechanism 10 provides suppression of a fire and allows for more time for personnel to egress from confined spaces or other hazardous environments. It is also capable of "knockdown" and fire suppression for enclosed spaces and offers a reliable and cost effective method of fire protection in a wide range of applications.

The present actuation mechanism 10 also may be employed in embodiments using a thermal reactive device that automatically releases the actuation mechanism, and ultimately the fire suppressant at specified temperatures or on contact with flames. The actuation mechanism 10 may further be used in conjunction with a power interruption device, which when activated closes a circuit, eliminating a source of fuel for the fire. For example, the lock pin 12 used to hold the piston 26 in place (as explained below), could be replaced by other locking mechanism that are actuated via heat or electronics.

Briefly, and as discussed below in greater detail, in the event of a fire, the present actuation mechanism 10 is manually activated in two steps: One—pull the locking pin 12; and Two—throw or place the unit at or near the fire. The device will actuate following a predetermined time delay. Upon activation, the fire extinguisher 100 with the present actuation mechanism 10 secured thereto produces an effective suppressant that provides fast knockdown and rapid suppression of fires.

In particular, a fire extinguisher 100 generally includes a canister (or body) 104 onto which an actuation mechanism 10 in accordance with the present invention is secured. With the exception of utilization of the present actuation mechanism 10, the fire extinguisher 100 employing the present delayed actuation mechanism 10 operates in much the same manner as a conventional fire extinguisher. As such, the fire extinguisher 100 includes a fire extinguisher canister 104 filled under pressure with a fire suppressant 102 in a manner forcibly causing the fire suppressant 102 to be expelled from an outlet valve 106 positioned at the top of the extinguisher canister 104 with substantial force upon release. The outlet valve 106 is a traditional pressure actuation valve that opens for release of the pressurized contents when the outlet valve 106 pressed downwardly during use. When no pressure is applied to the outlet valve 106 the fire suppressant 102 is prevented from escaping the extinguisher canister 104.

Controlled release of the fire suppressant 102 from the fire extinguisher canister 104 is achieved through the utilization of the present actuation mechanism 10. As will be discussed below in greater detail, the actuation mechanism 10 includes a housing in which the fire extinguisher 100 is contained in the assembled device, referred to herein as the fire extinguisher housing 11. The actuation mechanism also includes a pneumatically controlled time delayed activation piston assembly 14 that functions to control the release of fire suppressant 102 until desired by the user of the fire extinguisher 100. The pneumatically controlled time delayed activation piston assembly 14 is secured to the first extinguisher housing 11, and ultimately fire extinguisher 100, via an attachment sleeve 16 extending downwardly from the pneumatically controlled time delayed activation piston assembly 14 to connect the pneumatically controlled time delayed activation piston assembly 14 to the fire extinguisher 100 in a manner pressing down upon the outlet valve 106 to allow for the flow of fire suppressant from the extinguisher canister 104 and thereafter permitting fluid communication from the fire extinguisher canister 104, through the pneumatically controlled time delayed activation piston assembly 14 and out dispensing holes 18 found in the pneumatically controlled time delayed activation piston assembly 14 in a manner discussed below in greater detail.

The attachment sleeve 16 is provided with threading 20 for attachment to a threaded opening 76 in the fire extinguisher housing 11. The attachment sleeve 16 also includes a central passageway 22 that aligns with the outlet valve 106 of the fire extinguisher 100 permitting the flow of fire suppressant 102 in a manner discussed below in greater detail. In particular, the fire extinguisher housing 11 is shaped and dimensioned for the positioning of the first extinguisher 100 therein. The fire extinguisher housing 11, therefore, includes a cylindrical side wall 11*a*, an open bottom end 11*b* and a closed top wall 11*c* in which the threaded opening 76 mentioned above is formed. In this way, the first extinguisher 100 may be slid upwardly through the open bottom end lib with the top of the fire extinguisher 100 pushed upwardly until the output valve 106 is positioned adjacent to the top wall 11*c* and the threaded opening 76. The fire extinguisher 100 is secured within the fire extinguisher housing 11 via adhesive 13 positioned between the outer wall 104*a* of the fire extinguisher canister 104 and the inner wall 11*d* of the fire extinguisher housing 11. The adhesive also functions to prevent the flow of fire suppressant 102 out the bottom end 11*b* when the device is actuated so that all of the fire suppressant 102 flows through the pneumatically controlled time delayed activation piston assembly 14 as explained below. In addition, the rim 108 at the top of the fire extinguisher canister 104 also helps to prevent the flow of fire suppressant 102 out the bottom end 11*b* when the rim is pressed against the bottom of the top wall 11*c*. While the top wall is shown integrally formed with the side wall, it is appreciated the top and side walls may be formed as separate units if desired.

Figure 8:
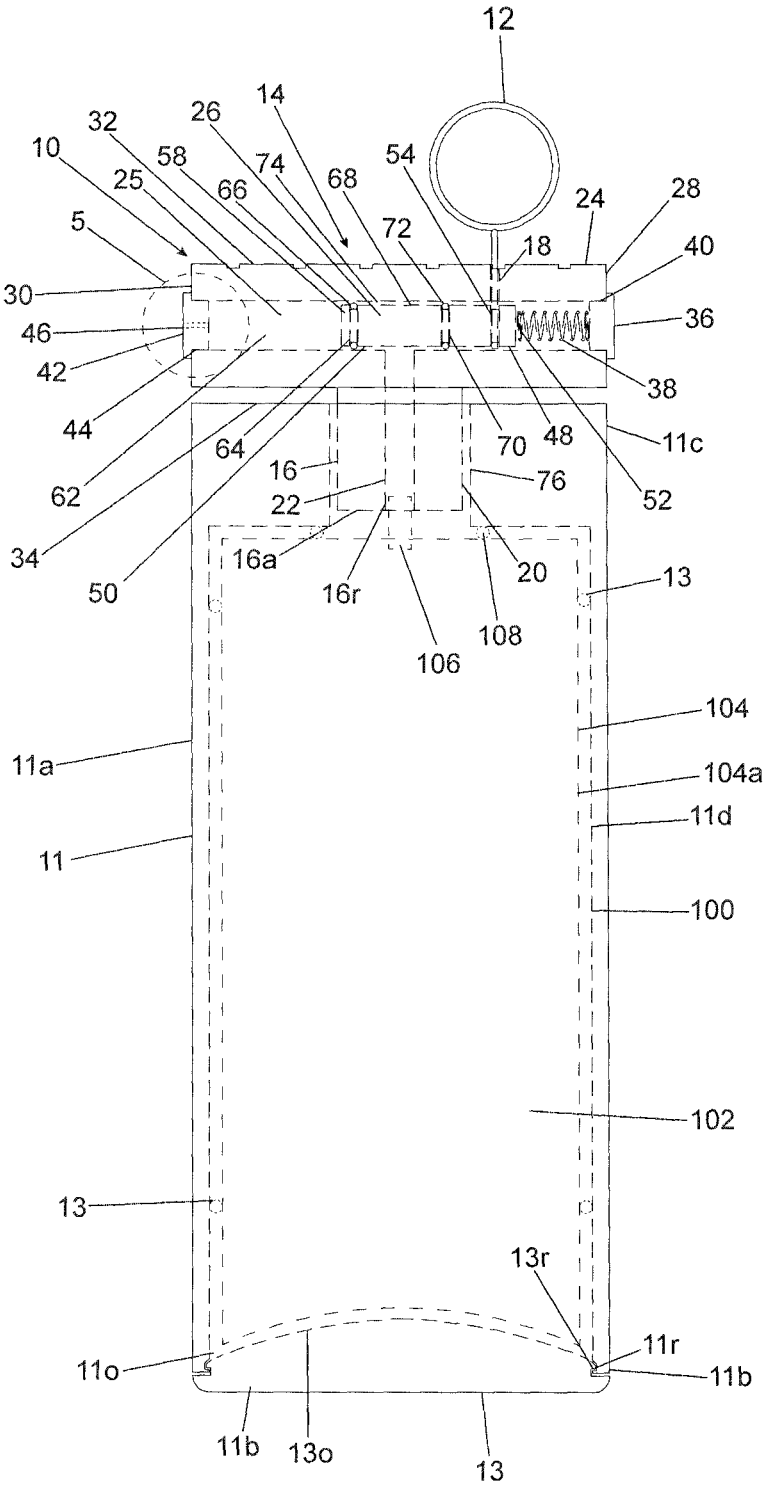
FIGS. 8 and 9 are side views of the actuation mechanism in accordance with alternate embodiments.

While adhesive is disclosed above for use in securing the fire extinguisher within the fire extinguisher housing, an alternate embodiment provides a bottom cap 13 for securing the fire extinguisher 100 within the fire extinguisher housing 11. In accordance with such an embodiment (please note that similar references numerals have been used for this embodiment), and with reference to FIG. 8, the bottom end 11*b* of the fire extinguisher housing 11 is open and a bottom cap 13 is provided for positioning within the opening 110 defined by the bottom end 11*b* so as to securely enclose the fire extinguisher 100 within the fire extinguisher housing 11. The inner wall 11*d* of the fire extinguisher housing 11 adjacent the bottom end 11*b* is provided with a recess 11*r* that is shaped and dimensioned to receive a rib 13*r* formed along the outer surface 13*o* of the bottom cap 13. In this way, when the bottom cap 13 is forced within the opening 13*o* defined in the bottom end 13*b* of the fire extinguisher housing 11, the recess 11*r* and rib 13*r* engage to frictionally hold the bottom cap 13 within the opening 13*o*. Because of the fact the bottom of most fire extinguisher canister 104 that might be used in conjunction with the present invention are formed with a concave surface, the upper surface 13*u* of the bottom cap 13 is formed with a convex surface shaped and dimensioned to substantially conform with the concave surface formed along the bottom of the fire extinguisher canister 104.

Because the outlet valve 106 is positioned adjacent to the top wall 11*c* and the threaded opening 76, the outlet valve 106 is actuated when the attachment sleeve 16 is screwed downwardly into the threaded opening 76 and the bottom surface 16*a* of the attachment sleeve 16 engages (that is, presses downwardly upon (for example, see FIGS. 2 and 6A where the bottom surface 16*a* is slightly above the outlet valve 106 and FIGS. 3, 4, and 6B where the attachment sleeve 16 has been screwed downwardly to press against the outlet valve 106) the outlet valve 106 to open the outlet valve 106 and allow for the flow of fire suppressant 102 from the fire extinguisher 100. As such, one can wait until a desired time to fully screw the attachment sleeve 16 down within the threaded opening 76 and open the outlet valve 106. The interaction between the bottom surface 16*a* of the attachment sleeve 16 and the outlet valve is further enhanced by the provision of a recess 16*r* along the bottom surface 16*a* that is shaped and dimensioned to fit about the outlet valve 106 so that the outlet valve 106 is proper aligned with the central passageway 22 of the attachment sleeve 16. It is also appreciated, that a locking mechanism may be incorporated into the threaded opening to prevent the removal of the attachment sleeve once it has been screwed downwardly to open the outlet valve.

While the present actuation mechanism 10 is disclosed for use in conjunction with a fire extinguisher, it is contemplated it could be used in other similar applications. For example, it is contemplated it could be used as a replacement for a sprinkler head in an existing fire prevention system.

The pneumatically controlled time delayed activation piston assembly 14 includes an actuator housing 24 shaped and dimensioned for receiving a piston 26. The actuator housing 24 includes a first end 28, a second end 30, a top surface 32 and a bottom surface 34. The actuator housing 24 also includes a cylindrical passageway 25 that runs from the first end 28 of the actuator housing 24 to the second end 26 of the actuator housing 24. The passageway 25 is in fluid communication with small apertures 18 formed in the actuator housing 24 to allow for the flow of fluid from the passageway 25 to the top surface 32 of the actuator housing 24. As such, the small apertures 18 extend between the top surface 32 and the passageway 25. While a circular shape for the actuator housing is disclosed in accordance with a preferred embodiment, and the first and second ends are respectively at diametrically opposed portions of the actuator housing, it is appreciated other shapes may be employed.

Many of the functional components of the pneumatically controlled time delayed activation piston assembly 14 are housed within the passageway 25 for movement in a manner discussed below in detail. The passageway 25 at the first end 28 of the actuator housing 24 is covered with a first cap 36 supporting a spring 38 interposed between the piston 26 and the first cap 36. The first cap 36 is screwed into an opening 40 formed in the first end 28 of the actuator housing 24. The passageway 25 at the second end 30 of the actuator housing 24 is provided with a second cap 42. The second cap 42 is screwed into an opening 44 formed in the second end 30 of the actuator housing 24 and includes a vent hole 46, the use of which is explained below in greater detail.

The piston 26, under the control of balanced spring bias from the spring 38 and pneumatic pressure created between the piston 26 and the second cap 42, allows for time delayed release of the fire suppressant 102 from the fire extinguisher canister 104. More particularly, the piston 26 includes a first end 48 and a second end 50. The first end 48 of the piston 26 is shaped and dimensioned for engaging the end 52 of the spring 38 opposite the first cap 36 at the first end 28 of the actuator housing 24. As a result, the piston 26 is biased toward the second end 30 of the actuator housing 24.

Adjacent the first end 48 of the piston 26, and between the first end 48 and the second end 50 of the piston 26, an annular shaped recess 54 is formed. The recess 54 serves two purposes. First, it allows for the positioning of the locking pin 12 therein for the purpose of preventing movement of the piston 26 until desired. Second, it provides a pathway for the flow of fire suppressant 102 in a manner that will be discussed below in greater detail.

Figure 2:
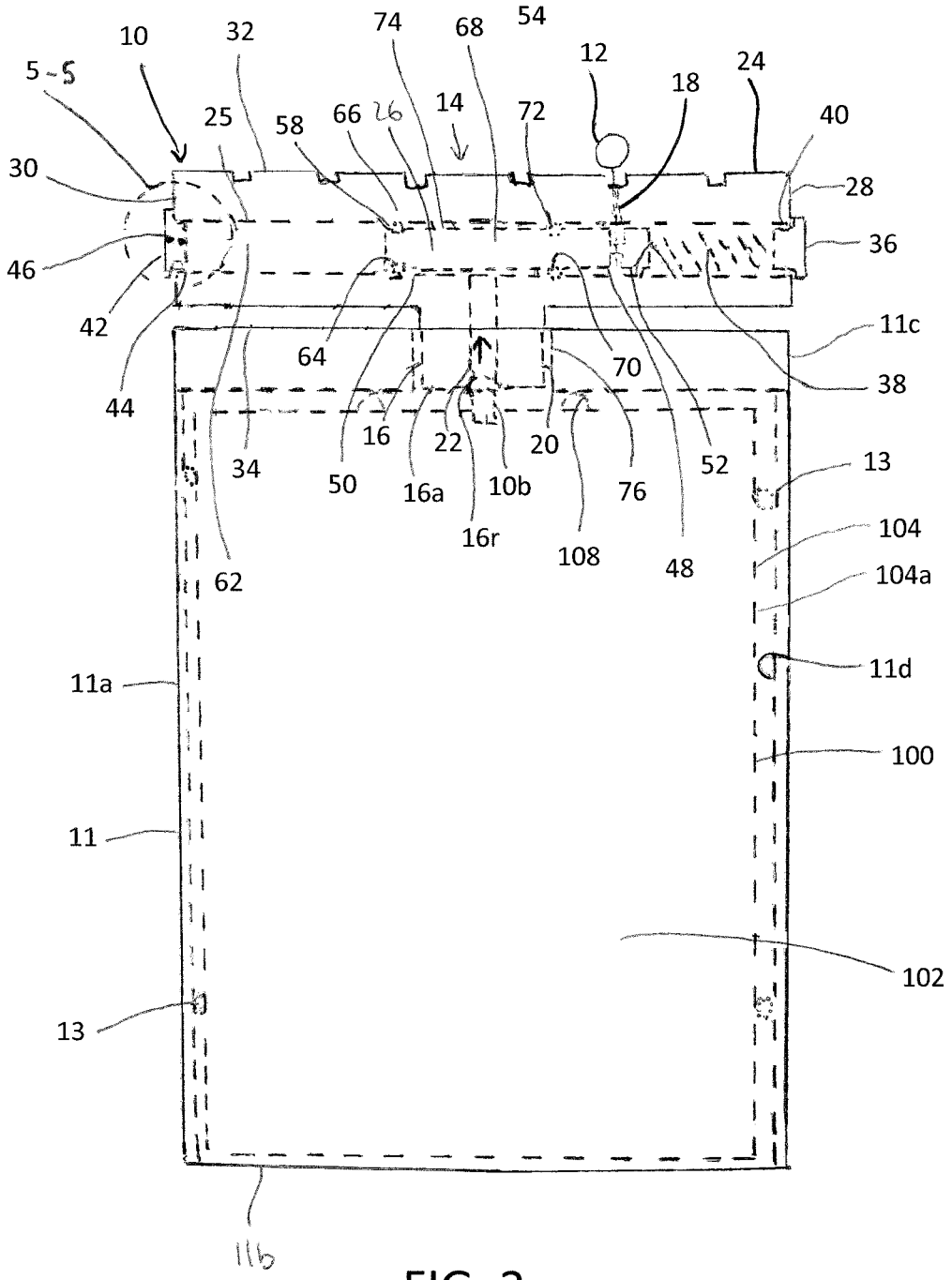
FIGS. 2, 3 and 4 are respectively side views of the actuation mechanism in various stages of use with the internal components shown in broken lines.
Figure 6A:
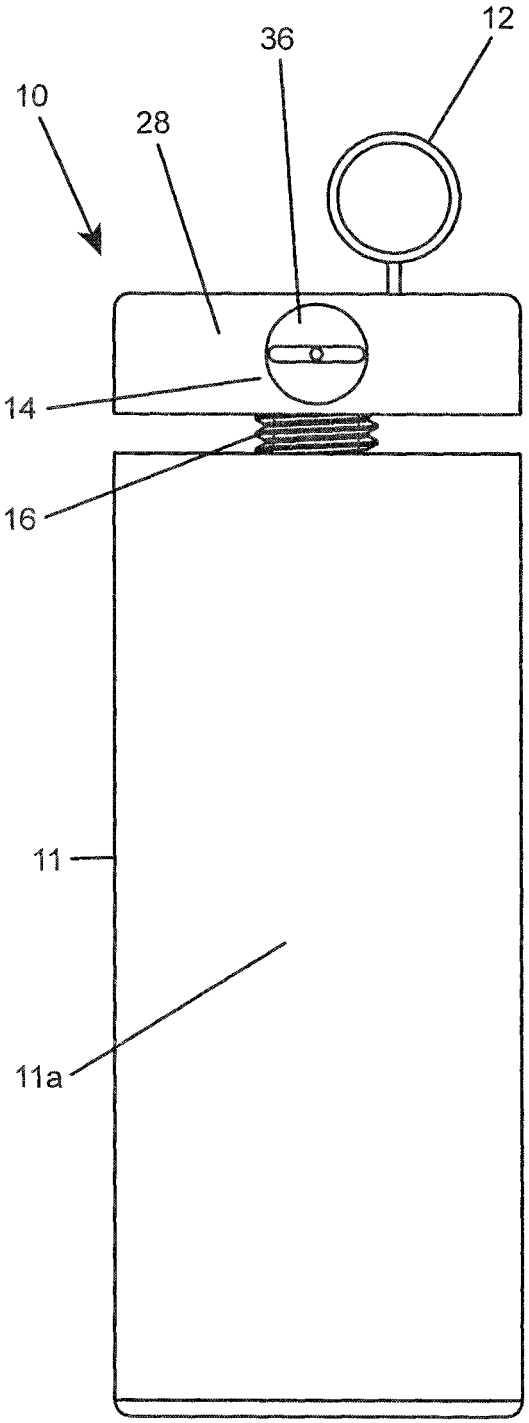
FIGS. 6A and 6B are side views of the actuation mechanism fully assembled with the fire extinguisher mounted within the fire extinguisher housing (but not shown) respectively showing the actuation mechanism with the attachment sleeve of the pneumatically controlled time delayed activation piston assembly only partially screwed down within the fire extinguisher as shown in FIG. 2 and the actuation mechanism with the attachment sleeve of the pneumatically controlled time delayed activation piston assembly screwed downwardly to press against the outlet valve of the fire extinguisher housed within the fire extinguisher housing.
Figure 6B:
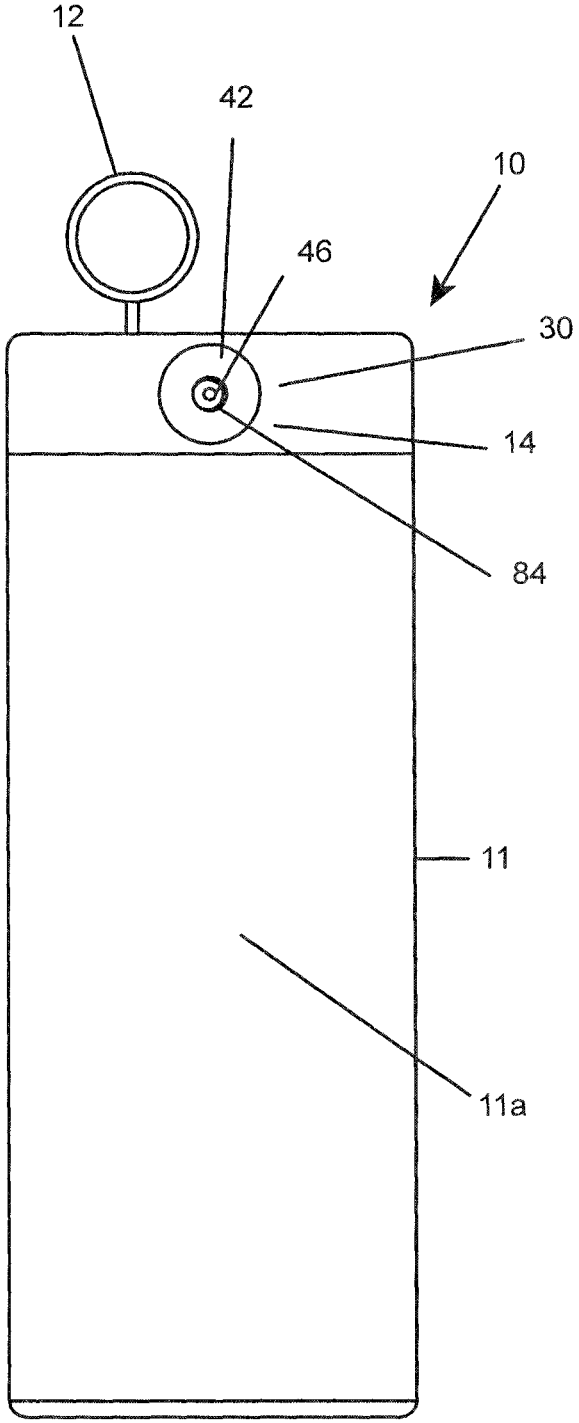
Figure 7A:
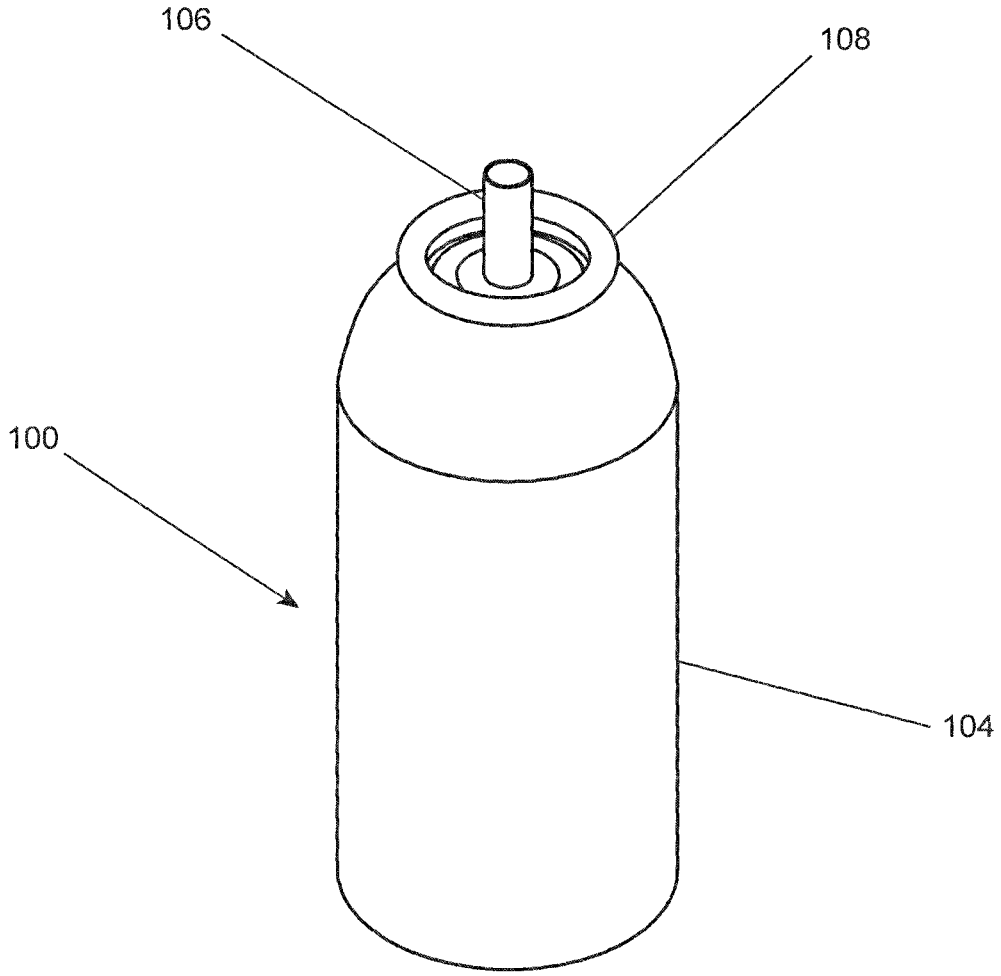

With regard to the use of the annular shaped recess 54 as a mechanism to control movement of the piston 26 based upon interaction with the locking pin 12, one of the small apertures 18 extending between the passageway 25 and the top surface 32 of the actuator housing 24 is shaped and dimensioned to allow for the passage of the locking pin 12 therethrough and into the annular shaped recess 54 when the piston 26 is in its storage, non-firing position (as discussed below and shown with reference to FIGS. 2 and 6A).

The second end 50 of the piston 26 includes a sealed piston head 58 shaped and dimensioned for engaging the inner wall 60 of the passageway 25 of the actuator housing 24 in manner defining a substantially sealed lateral compartment 62 in the actuator housing 24, that is, a compartment between the second end 50 of the piston 26 and the second cap 42. The piston head 58 is provided with a circumferential recess 64 in which a sealing member, for example, an O-ring 66, is positioned.

Figure 3:
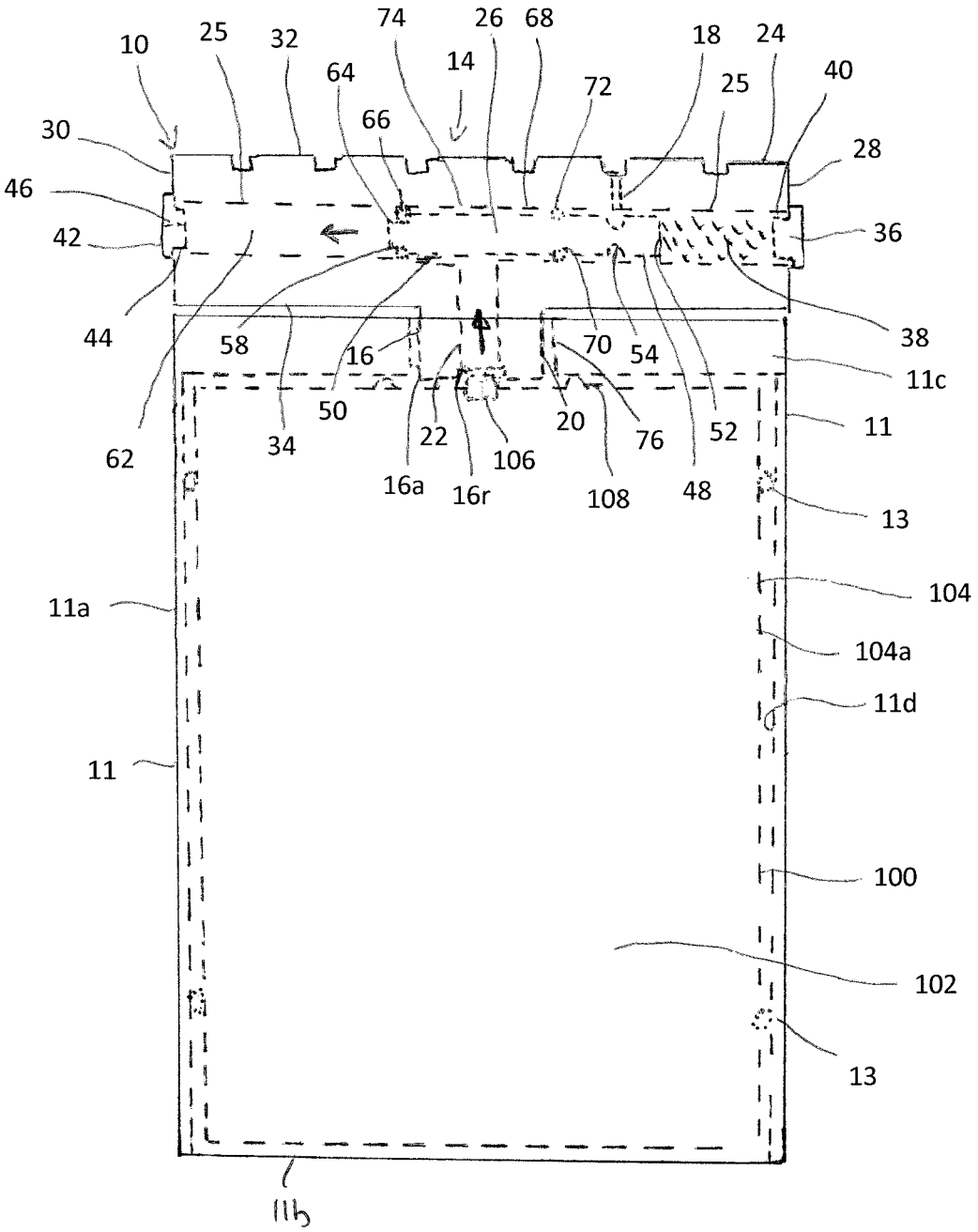

A central section 68 of the piston 26 is also provided with a circumferential recess 70 in which a sealing member, for example, an O-ring 72, is positioned. The O-ring 66 of the piston head 58 at the second end 50 of the piston 26 and the O-ring 72 of the central section 68 form a sealed section 74 when the piston 26 is positioned within the passageway 25 by contacting the inner wall 60 of the passageway 25 in a sealing manner. This sealed section 74, when aligned with the passageway 22 of the attachment sleeve 16 (and ultimately the outlet 108 of the fire extinguisher 100) as shown in FIGS. 2 and 3 prevents the flow of fluid when the piston 26 is in its storage position.

With this in mind, and considering the spring 38 functioning to bias the piston 26 toward the second end 30 of the actuator housing 24 against the sealed lateral compartment 62, it is necessary to vent the sealed lateral compartment 62 to allow for movement of the piston 26 toward the second end 30 of the actuator housing 24. Accordingly, and as briefly mentioned above, the second cap 42 is provided with a vent hole 46 allowing air from the sealed lateral compartment 62 to be forced out of the sealed lateral compartment 62, and into the atmosphere, as the spring 38 attempts to move the piston 26 toward the second end 30 of the actuator housing 24.

The vent hole 46 is, in accordance with a preferred embodiment constructed as an adjustable bleed valve. In particular, and with reference to FIG. 5, the second cap 42 includes and cap aperture 78 extending from a first end 80 thereof to a second end 82 thereof. The first end 80 faces the sealed lateral compartment 62 while the second end 82 is positioned along the exterior surface of the second cap 42. As such, air is free to flow through the cap aperture 78 from the first end 80 of the second cap 42 to the second end 82 of the second cap 42. An adjustable bleed valve member 84 is threadingly positioned within the cap aperture 78 at the second end 82 of the second cap 42 and controls the flow of air out of the sealed lateral compartment 62. As will be explained below in greater detail, by controlling the flow of air out of the sealed lateral compartment 62 one can control the movement of the piston 26 toward the second end 30 of the actuator housing 24.

Figure 5:
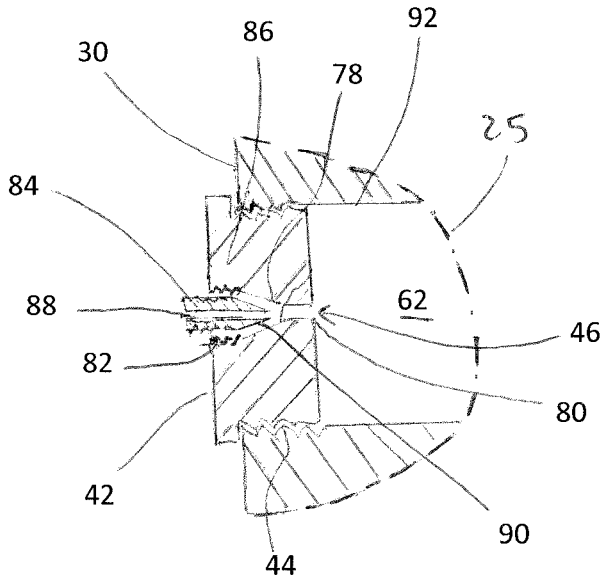
FIG. 5 is a cross section view along the section 5-5 in FIG. 2.

As is known to those skilled in the art, and with reference to FIG. 5 (which is not to scale), the adjustable bleed valve member 84 has an resilient elongated body 86 with a central longitudinal bleed valve aperture 88. The first end 90 of the adjustable bleed valve member 84 is tapered downwardly such that it engages a similarly tapered wall 92 of the cap aperture 78 of the second cap 42 to cause changes in the application of internal force at first end 90 of the bleed valve member 84 and thereby allow for the size of the bleed valve aperture 88 at the first end 90 thereof to be adjusted as the adjustable bleed valve member 84 is moved into and out of the cap aperture 78 under the control of twisting the adjustable bleed valve member 84 clockwise (to reduce the size of the bleed valve aperture 88) or twisting the adjustable bleed valve member 84 counterclockwise (to increase the size of the bleed valve aperture 88).

Because the speed at which the piston 26 will move within the passageway 25 is a function of the spring pressure being applied by the spring 38 and the size of the vent hole 46 as determined by the positioned of the bleed valve member 84 within the cap aperture 78, the present pneumatically controlled time delayed activation piston assembly 14 allows for pneumatically controlled movement of the piston 26 from its start position toward the second end 30 of the actuator housing 24. The adjustable vent hole 46 provided in accordance with the present invention allows for adjustment of the time for release of the fire suppressant from 1 second to 1 minute, or longer if desired.

Figure 4:
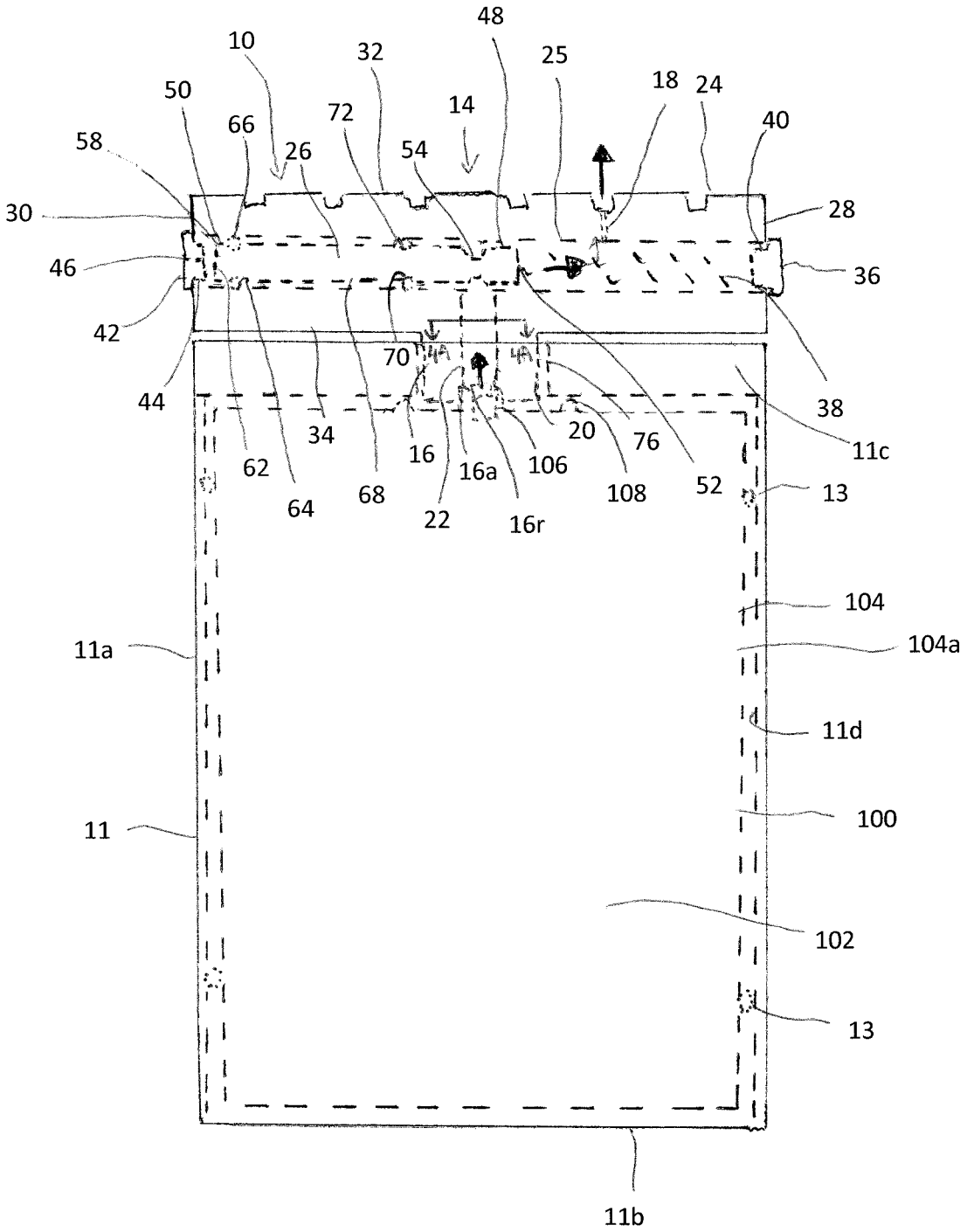
Figure 4A:
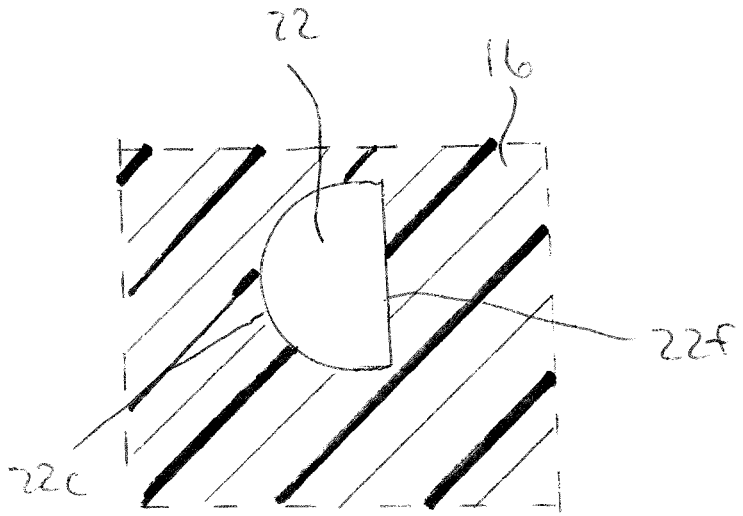
FIG. 4A is a cross-sectional view along the line 4A-4A in FIG. 4.

As discussed above, and with reference to FIGS. 2, 3 and 4, when the sealed section 74 is aligned with the passageway 22 of the attachment sleeve 16 of the pneumatically controlled time delayed activation piston assembly 14 the flow of pressurized fire suppressant 102 is prevented until such a time as the locking pin 12 is removed and the piston 26 moves from its storage orientation (with the sealed section 74 aligned with the passageway 22 of the attachment sleeve 16) to its active orientation (with the annular recess 54 aligned with the passageway 22 of the attachment sleeve 16). In particular, FIG. 2 shows the actuation mechanism 10 with the locking pin 12 in place to prevent movement of piston 26 and the sealed section 74 of the piston 26 aligned with the passageway 22 of the attachment sleeve 16 of the pneumatically controlled time delayed activation piston assembly 14 to prevent the flow of pressurized fire suppressant 102. FIG. 3 shows the actuation mechanism 10 in its use orientation with locking pin 12 removed and the piston 26 free to move, but still with the sealed section 74 of the piston 26 aligned with the passageway 22 of the attachment sleeve 16 of the pneumatically controlled time delayed activation piston assembly 14 to prevent the flow of pressurized fire suppressant 102. FIG. 4 shows the active orientation after the piston 26 moves toward the second end 30 and the annular recess 54 is aligned with the passageway 22 of the attachment sleeve 16 to allow for the flow of fire suppressant 102. In accordance with a preferred embodiment, and as shown with reference to FIG. 4A, the passageway 22 is formed with a D-shaped cross-sectional profile, wherein the straight edge 22*f* faces the first end 28 and the curved edge 22*c* faces the second end 30. The provision of the straight edge 22*f* allows for more consistent release of the fire suppressant 102 as the O-ring 72 moves over the passageway 22

As discussed above, the speed at which the piston 26 moves is a function of the force applied by the spring 38 and the amount of air allowed to pass through the vent hole 46. Referring to FIG. 4, once the piston 26 is pushed toward the second end 30 of the actuator housing 24 so that the annular recess 54 aligns with the passageway 22 of the attachment sleeve 16, pressurized fire suppressant 102 is allowed to flow from the fire extinguisher canister 104, through the attachment sleeve 16 and through the dispensing holes 56 formed along the top surface 32 of the actuator housing 24.

The annular recess 54 is integrated with the piston 26 and comes into alignment with the passageway 22 of the attachment sleeve 16 at a specific time and location after the locking pin 12 is removed and the piston 26 is released from its starting position. With reference to FIG. 2, the start position of the piston 26 is at the first end 48 of the piston 26 located adjacent to the first end 30 of the actuator housing 24, and with the sealed section 74 of the piston 26 covering the passageway 22 of the attachment sleeve 16 and preventing the flow of fire suppressant 102 beyond the sealed section 74. The piston 26 is held in position, when in its start position, by the locking pin 12 extending through one of the small apertures 18 extending between the passageway 25 and the top surface 32 of the actuator housing 24 and through the annular recess 54.

Referring to FIG. 4, when the annular recess 54 of the piston 26 moves into alignment with the passageway 22 of the attachment sleeve 16 the pressurized fire suppressant 102 is free to exit the fire extinguisher canister 104, pass through the passageway 22 defined by the attachment sleeve 16, enter the passageway 25 defined by the actuator housing 24 and forcefully spray from the small apertures 18 formed in the top surface 32 of the actuator housing 24. Flow of fire suppressant 102 is further ensured by the provision of laterally oriented grooves 80 along the top surface 32 of the actuator housing 24. As such, if the top surface 32 is covered, the fire suppressant 102 will flow through the grooves 80 and beyond the edges of the actuator housing 24 so that it may interact with the fire and perform its function.

Figure 9:
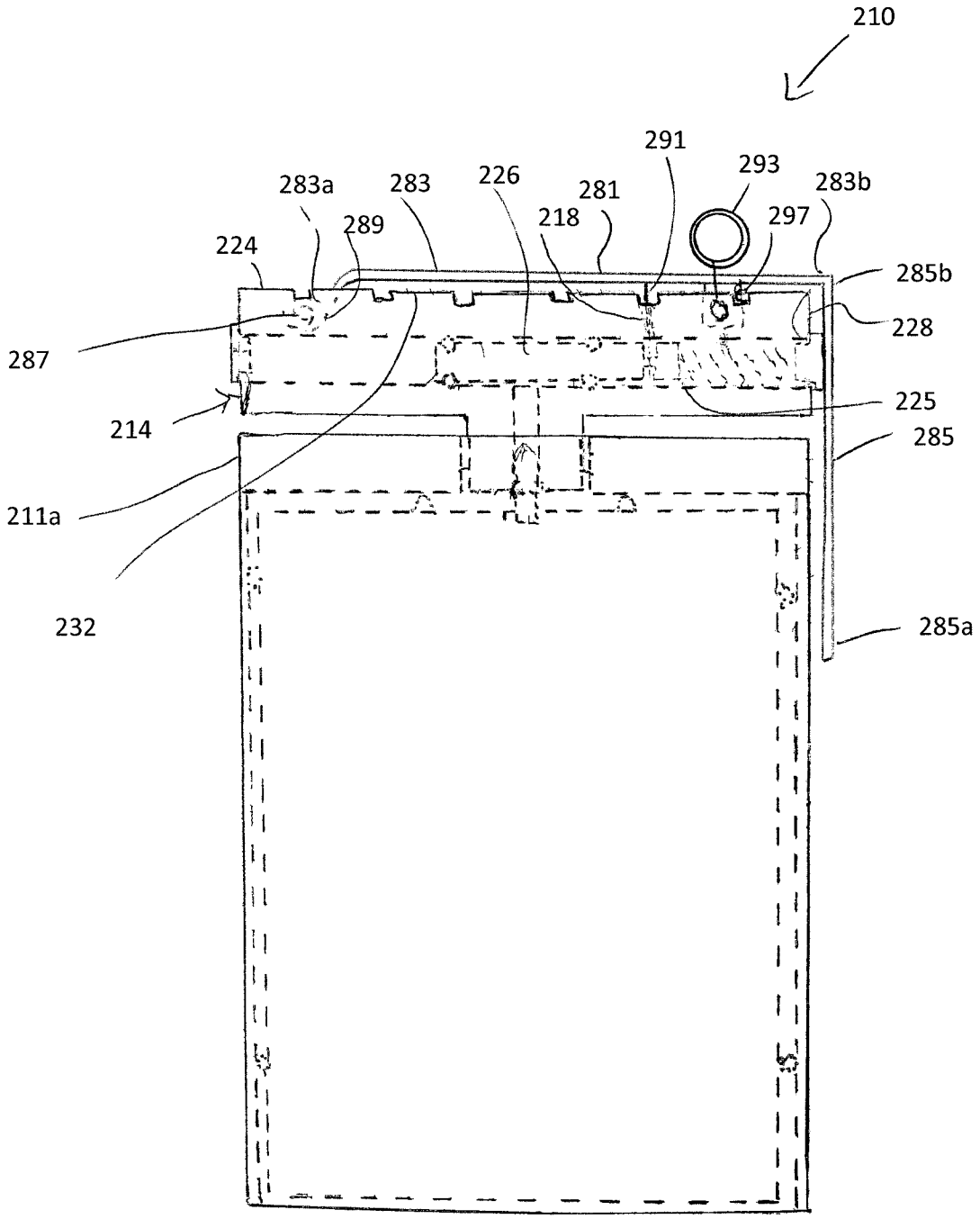

While a locking pin is disclosed above for use in preventing movement of the piston until desired, other mechanism could be employed. For example, and with reference to FIG. 9, the locking pin is replaced with a release lever 281 pivotally mounted to the actuator housing 224 of the pneumatically controlled time delayed activation piston assembly 214 for controlled release of the piston 226. The release lever 281 is substantially L-shaped and includes a first segment 283 shaped and dimensioned to lie over the top surface 232 of the actuator housing 224 and a second segment 285, which is oriented substantially perpendicular to the first segment 283, shaped and dimensioned for positioning along the first end 228 of the actuator housing 224 and the cylindrical side wall 211*a* of the fire extinguisher housing 211. The first segment 283 includes a free first end 283*a* and second end 283*b*, while the second segment 285 includes a free first end 285*a* and a second end 285*b* that is connected to the second end 283*b* of the first segment 283. The free first end 283*a* of the first segment 283 is secured to a pivot pin 287 formed along the top surface 232 of the actuator housing 224. As such, and in accordance with a preferred embodiment, the free first end 283*s* of the first segment 283 includes a bent section 289 shaped and dimensioned to fit about the pivot pin 287 and allow the release lever 281 to pivot thereabout as will be described below.

The underside of the first segment 283 also includes a locking pin 291 that extends downwardly therefrom and is shaped and dimensioned to pass through one of the small apertures 218 extending between the passageway 225 and the top surface 232 of the actuator housing 224 so as to allow for the passage of the locking pin 291 therethrough and into the annular shaped recess 254 when the piston 226 is in its storage, non-firing position. As such, and when the device 210 is in its storage, non-firing position, the release lever 281 is wrapped about the actuator housing 224 and the fire extinguisher housing 211. With the bent section 289 of the first segment 283 wrapped about the pivot pin 287, the release lever 281 is held in position by a release pin 293 that passes through both the release lever 281 and a portion of the actuator housing 224.

When it is desired to use the actuation mechanism 210, the user, with his or her hand about the fire extinguisher housing 211 and the second segment 285 of the release lever 281, pulls the release pin 293 from the release lever 281 and a portion of the actuator housing 224 through which it passes. At this point the release lever 281 is free to move away from the actuator housing 224 and the fire extinguisher housing 211. Movement of the release lever 281 away from the actuator housing 224 and the fire extinguisher housing 211 is achieved by the provisional of a spring 297 between the top surface 232 of the actuator housing 224 and the first segment 283 of the release lever 281. As the release lever 281 is forced away from the actuator housing 224 and the fire extinguisher housing 211 and rotates about the pivot pin 287, the locking pin 291 is pulled from the piston 226 and the piston 226 is free to move as described above. The bent section 289 of the first segment 283 is not fixedly coupled to the pivot pin 287 so the release lever 281 will fly away from the actuator housing 224 and the fire extinguisher housing 211 once it is released. If it is desired to keep the release lever 281 connected to the actuator housing and/or the fire extinguisher housing, a tether of some sort may be attached between the release lever and the actuator housing and/or the fire extinguisher housing.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A fire extinguisher with a delayed release actuation mechanism, comprising:

a fire extinguisher including a fire extinguisher canister filled under pressure with a fire suppressant in a manner forcibly causing the fire suppressant to be expelled from the fire extinguisher with substantial force upon release;

an actuation mechanism secured to the fire extinguisher canister for controlling expulsion of the fire suppressant from the fire extinguisher, the actuation mechanism includes:

a pneumatically controlled time delayed activation piston assembly that functions to control the time delayed release of the fire suppressant, the pneumatically controlled time delayed activation piston assembly includes an actuator housing having a passageway in which a piston is positioned;

the actuator housing includes a first end and second end, and the passageway extends from the first end to the second end, the passageway at the first end of the actuator housing is covered with a first cap supporting a spring interposed between the piston and the first cap, and the passageway at the second end of the actuator housing is provided with a second cap having a vent hole resulting in the creation of pneumatic pressure between the piston and the second cap;

the piston includes a first end with an annular shaped recess and a second end with a sealed piston head;

the piston, under the control of spring bias generated by the spring and pneumatic pressure created between the piston and the second cap, allows for time delayed release of the fire suppressant from the fire extinguisher.

2. The fire extinguisher according to claim 1, wherein the first end of the piston is shaped and dimensioned for engaging an end of the spring opposite the first cap at the first end of the actuator housing, which spring biases the piston toward the second end of the actuator housing.

3. The fire extinguisher according to claim 1, wherein the sealed piston head is shaped and dimensioned for engaging an inner wall of the passageway of the actuator housing in a manner defining a substantially sealed lateral compartment in the actuator housing between the second end of the piston and the second cap.

4. The fire extinguisher according to claim 3, wherein the sealed piston head is provided with a circumferential recess in which an O-ring is positioned.

5. The fire extinguisher according to claim 4, wherein a central section of the piston is also provided with a circumferential recess in which an O-ring is positioned, the O-ring of the sealed piston head at the second end of the piston and the O-ring of the central section form a sealed section.

6. The fire extinguisher according to claim 5, wherein the vent hole allows air from the sealed lateral compartment to be forced out of the sealed lateral compartment.

7. The fire extinguisher according to claim 1, wherein the annular shaped recess allows for positioning of a locking pin therein for preventing movement of the piston and provides a pathway for the flow of fire suppressant.

8. The fire extinguisher according to claim 1, further including a locking pin holding the piston in a desired orientation prior to use.

9. The fire extinguisher according to claim 1, wherein the pneumatically controlled time delayed activation piston assembly is secured to the fire extinguisher via an attachment sleeve that connects the actuation mechanism to the fire extinguisher in a manner permitting fluid communication from the fire extinguisher.

10. The fire extinguisher according to claim 9, wherein the sealed piston head is shaped and dimensioned for engaging an inner wall of the passageway of the actuator housing in a manner defining a substantially sealed lateral compartment in the actuator housing between the second end of the piston and the second cap, the sealed piston head being provided with a circumferential recess in which an O-ring is positioned and a central section of the piston is also provided with a circumferential recess in which an O-ring is positioned, the O-ring of the sealed piston head at the second end of the piston and the O-ring of the central section form a sealed section preventing the flow of fire suppressant from the fire extinguisher when the sealed section is aligned with the attachment sleeve.

11. An actuation mechanism, comprising:

a pneumatically controlled time delayed activation piston assembly that functions to control release until desired by the user, the pneumatically controlled time delayed activation piston assembly includes:

an actuator housing having a passageway in which a piston is positioned;

the actuator housing includes a first end and second end, and the passageway extends between the first end and the second end, the passageway at the first end of the actuator housing is covered with a first cap supporting a spring interposed between the piston and the first cap, and the passageway at the second end of the actuator housing is provided with a second cap having a vent hole resulting in the creation of pneumatic pressure between the piston and the second cap;

the piston includes a first end with an annular shaped recess and a second end with a sealed piston head;

the piston, under the control of balanced spring bias generated by the spring and pneumatic pressure created between the piston and the second cap, allows for time delayed release.

12. The actuation mechanism according to claim 11, wherein the first end of the piston is shaped and dimensioned for engaging an end of the spring opposite the first cap at the first end of the actuator housing, which spring biases the piston toward the second end of the actuator housing.

13. The actuation mechanism according to claim 11, wherein the sealed piston head is shaped and dimensioned for engaging an inner wall of the passageway of the actuator housing in a manner defining a substantially sealed lateral compartment in the actuator housing between the second end of the piston and the second cap.

14. The actuation mechanism according to claim 13, wherein the sealed piston head is provided with a circumferential recess in which an O-ring is positioned.

15. The actuation mechanism according to claim 14, wherein a central section of the piston is also provided with a circumferential recess in which an O-ring is positioned, the O-ring of the sealed piston head at the second end of the piston and the O-ring of the central section form a sealed section.

16. The actuation mechanism according to claim 15, wherein the vent hole allows air from the sealed lateral compartment to be forced out of the sealed lateral compartment.

17. The actuation mechanism according to claim 11, wherein the annular shaped recess allows for positioning of a locking pin therein for preventing movement of the piston and provides a pathway for flow.

18. The actuation mechanism according to claim 11, further including a locking pin holding the piston in a desired orientation prior to use.

19. The actuation mechanism according to claim 11, further including an attachment sleeve that connects the actuation mechanism to a fire extinguisher in a manner permitting fluid communication from the fire extinguisher.

20. The actuation mechanism according to claim 19, wherein the sealed piston head is shaped and dimensioned for engaging an inner wall of the passageway of the actuator housing in a manner defining a substantially sealed lateral compartment in the actuator housing between the second end of the piston and the second cap, the sealed piston head being provided with a circumferential recess in which an O-ring is positioned and a central section of the piston is also provided with a circumferential recess in which an O-ring is positioned, the O-ring of the sealed piston head at the second end of the piston and the O-ring of the central section form a sealed section preventing flow of a fire suppressant from the fire extinguisher when the sealed section is aligned with the attachment sleeve.

* * * * *